US011495071B2

(12) United States Patent
Tzirimis

(10) Patent No.: US 11,495,071 B2
(45) Date of Patent: Nov. 8, 2022

(54) RULES-BASED AREA ACCESS MANAGEMENT SYSTEM USING PERSONAL AREA NETWORKS

(71) Applicant: Intrex, Reston, VA (US)

(72) Inventor: Ted Tzirimis, Reston, VA (US)

(73) Assignee: INTREX, Reston, VA (US)

( * ) Notice: Subject to any disclaimer, the term of this patent is extended or adjusted under 35 U.S.C. 154(b) by 0 days.

(21) Appl. No.: 17/162,312

(22) Filed: Jan. 29, 2021

(65) Prior Publication Data

US 2021/0241554 A1 Aug. 5, 2021

Related U.S. Application Data

(60) Provisional application No. 62/968,792, filed on Jan. 31, 2020.

(51) Int. Cl.
*G07C 9/00* (2020.01)
*G07C 9/27* (2020.01)

(52) U.S. Cl.
CPC ..... *G07C 9/00571* (2013.01); *G07C 9/27* (2020.01)

(58) Field of Classification Search
CPC ..... G07C 9/00
See application file for complete search history.

(56) References Cited

U.S. PATENT DOCUMENTS 7,671,718 B2 * 3/2010 Turner ..... G07C 9/257 340/8.1
8,941,465 B2 * 1/2015 Pineau ..... H04W 12/06 340/5.2
10,643,414 B2 * 5/2020 Davis ..... H04W 12/08

* cited by examiner

*Primary Examiner* — K. Wong
(74) *Attorney, Agent, or Firm* — MH2 Technology Law Group LLP

(57) ABSTRACT

A computer-implemented method, a system that performs the computer-implemented method, and a computer program product that stores instructions to perform the computer-implemented method are disclosed. The computer-implemented includes receiving a device ID and a door ID; retrieving a dynamic set of access rules for the door ID; determining whether the device ID is authorized based on the dynamic set of access rules; outputting an indication indicating that the device ID is authorized to effectuate unlocking or opening of a door associated with the door ID; outputting an indication indicating that the device ID is not authorized to prevent unlocking or opening of the door.

20 Claims, 6 Drawing Sheets

| Terminal Block | |
|---|---|
| + | Input + 12V dc |
| - | 0V - Ground |
| H | Clock |
| 0 | Wiegand data 0 |
| 1 | Wiegand data 1 |
| G | Green LED |
| R | Red LED |

RULES-BASED AREA ACCESS MANAGEMENT SYSTEM USING PERSONAL AREA NETWORKS

CROSS-REFERENCE TO RELATED APPLICATIONS

This application claims priority to U.S. Provisional Application No. 62/968,792 filed on Jan. 31, 2020, the disclosure of which is hereby incorporated by reference in its entirety.

BACKGROUND

Area access management may involve providing and revoking access to various areas to different individuals at different times. Access to a secure area may be secured by electronic door lock controls in which only authorized individuals having an electronic access device (e.g., access card, fob, etc.) may be granted access to the secure area.

SUMMARY

In accordance with examples of the present teachings, a computer-implemented method is provided. The computer-implemented method comprises receiving a device ID and a door ID; retrieving a dynamic set of access rules for the door ID; determining whether the device ID is authorized based on the dynamic set of access rules; outputting an indication indicating that the device ID is authorized to effectuate unlocking or opening of a door associated with the door ID; outputting an indication indicating that the device ID is not authorized to prevent unlocking or opening of the door.

Various additional features can be included in the computer-implemented method including one or more of the following features. The device ID is provided via an unlock signal provided by an electronic key device. The electronic key device includes at least one of: a keycard; a fob; and a mobile user device, or combinations thereof. The electronic key device provides the unlock signal through user input, wherein the user input comprises at least one of: a press of a physical button implemented on the electronic key device; and user input received via a graphical user interface implemented by the electronic key device, or combinations thereof. The device ID is received from an electronic key device via an access reader device. The access reader device comprises one or more environmental sensors for collecting environmental data. The environmental data obtained from the access reader device is included in the dynamic set of access rules.

In accordance with examples of the present teachings, a system is provided. The system comprises an electronic key device configured to provide an unlock signal comprising a device ID; an access reader configured to receive the unlock signal and transmit the unlock signal; a door access controller configured to receive the unlock signal and provide the device ID from the unlock signal and provide a door ID of a door controlled by the door access controller; an access control determination server comprising a computer readable storage medium having program instructions embodied therewith, the program instructions executable by a computing device to cause the computing device to perform operations comprising: receiving the device ID and the door ID from the door access controller; retrieving a dynamic set of access rules for the door ID; determining whether the device ID is authorized based on the dynamic set of access rules; outputting, to the door access controller, an indication indicating that the device ID is authorized to effectuate unlocking or opening of a door associated with the door ID via the door access controller; outputting an indication indicating that the device ID is not authorized to prevent unlocking or opening of the door.

Various additional features can be included in the system including one or more of the following features. The electronic key device is further configured to provide the unlock signal based on authenticating a user of the electronic key. The electronic key device is further configured to continuously provide the unlock signal. The electronic key is further configured to provide the unlock signal via a personal area network (PAN). The access controller is configured to transmit the unlock signal based on a signal strength of the unlock signal received from the electronic key device, wherein the signal strength is indicative of a distance between the electronic key device and the access controller. The access controller includes at least one integrated environmental sensor and is configured to provide data from the environmental sensor to the access control determination server.

In accordance with examples of the present teachings, a computer program product is provided. The computer program product comprises a computer readable storage medium having program instructions embodied therewith, the program instructions executable by a computing device to cause the computing device to perform operations comprising: receiving a device ID and a door ID; retrieving a dynamic set of access rules for the door ID; determining whether the device ID is authorized based on the dynamic set of access rules; outputting an indication indicating that the device ID is authorized to effectuate unlocking or opening of a door associated with the door ID; outputting an indication indicating that the device ID is not authorized to prevent unlocking or opening of the door.

Various additional features can be included in the computer program product including one or more of the following features. The device ID is provided via an unlock signal provided by an electronic key device. The electronic key device includes at least one of: a keycard; a fob; and a mobile user device, or combinations thereof. The electronic key device provides the unlock signal through user input, wherein the user input comprises at least one of: a press of a physical button implemented on the electronic key device; and user input received via a graphical user interface implemented by the electronic key device, or combinations thereof. The device ID is received from an electronic key device via an access reader device. The access reader device comprises one or more environmental sensors for collecting environmental data. The environmental data obtained from the access reader device is included in the dynamic set of access rules.

In accordance with examples of the present teachings, a computer-implemented method implemented by an access reader device is provided. The computer-implemented method comprises receiving an unlock signal from an electronic key device; determining whether the unlock signal should be transmitted to effectuate opening or unlocking a door based on one or more conditions associated with the unlock signal; transmitting the unlock signal to a door access controller based on determining that the one or more conditions have been satisfied; preventing the unlock signal from being transmitted based on determining that the one or more conditions have not been satisfied, wherein the one or more conditions include a signal strength of the unlock signal indicative of a distance between the electronic key device and the access reader device.

Various additional features can be included in computer-implemented method implemented by an access reader device including one or more of the following features. The device ID is provided via an unlock signal provided by an electronic key device. The electronic key device includes at least one of: a keycard; a fob; and a mobile user device, or combinations thereof. The electronic key device provides the unlock signal through user input, wherein the user input comprises at least one of: a press of a physical button implemented on the electronic key device; and user input received via a graphical user interface implemented by the electronic key device, or combinations thereof. The device ID is received from an electronic key device via an access reader device. The access reader device comprises one or more environmental sensors for collecting environmental data. The environmental data obtained from the access reader device is included in the dynamic set of access rules.

DETAILED DESCRIPTION

Figure 1A:
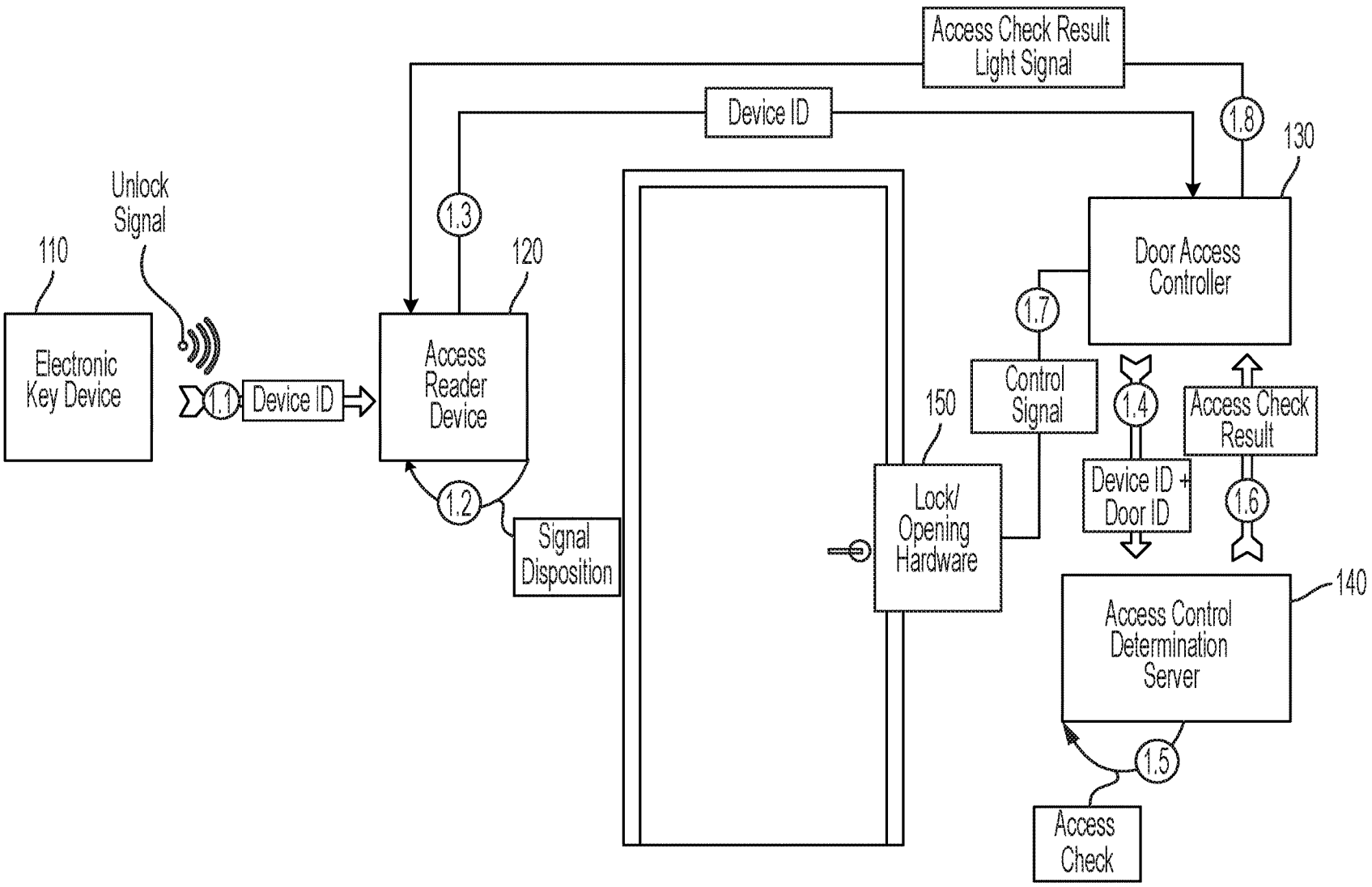
FIG. 1A illustrates an overview of an example implementation in accordance with aspects of the present disclosure.

Certain embodiments of the disclosure will hereafter be described with reference to the accompanying drawings, wherein like reference numerals denote like elements. It should be understood, however, that the accompanying drawings illustrate only the various implementations described herein and are not meant to limit the scope of various technologies described herein. The drawings show and describe various embodiments of the current disclosure.

Existing access management devices provide limited functionality in terms of communication protocols that may be used to communicate with keycards/fobs, etc. Further, access management (e.g., to secure areas) may require manual updating of information identifying individuals that are permitted to access a secure area (e.g., via an electronic door lock or electronic door control). The manual nature of access management may be time consuming and/or inaccurate (e.g., in the sense that certain individuals may be unintendedly permitted or denied access to a particular secure area).

Accordingly, aspects of the present disclosure include a system and/or method to centralize access control information and may implement a rules-based access control system to dynamically update access to secure areas based on dynamic and/or real-time conditions. Further aspects of the present disclosure may include an access reader device that implements a variety of communication protocols for communicating with electronic key devices used to unlock doors or otherwise gain access to a secure area. For example, aspects of the present disclosure may implement a personal area network (PAN) by leveraging Bluetooth, Bluetooth Low Energy (BLE), Near-field Communications (NFC), and/or other types of communication technologies. As a result, a wide variety of devices may be used as electronic keys and may be used to unlock a door from a configurable range of up to approximately 30 feet. Additionally, or alternatively, aspects of the present disclosure may include a battery back-up system that allows continued use of door lock/unlock features in the event of a power outage.

As described herein, aspects of the present disclosure may include an electronic key device. In some embodiments, the electronic key device may include a keycard, or a specialized fob having one or more physical and/or virtual buttons for broadcasting an unlock signal (e.g., a signal used to unlock a door). Additionally, or alternatively, the electronic key device may be a software component integrated within a user device (e.g., a mobile smartphone, a tablet, etc.). In some embodiments, the unlock signal may carry any variety information, such as a device ID, a user ID, and/or other information that may ultimately be used as part of a determination of whether the door should be unlocked.

Aspects of the present disclosure may further include an access reader device that is implemented on or near a door, and receives unlock signals from electronic key devices. In some embodiments, the access reader device may include a logical component that may intelligently disposition one or more unlock signals received from the electronic key devices based on a set of rules. More specifically, the access reader device may determine whether to "act" on the signal (e.g., by sending information from within the signal towards an access control determination server), or to disregard or refrain from acting on the signal. In some embodiments, the access reader device may include one or more integrated environmental sensors, such as temperature, humidity, air pressure, ambient sound, ambient light, etc. The data from the integrated environmental sensors may be used as part of the determination of how to disposition the received unlocked signals. Additionally, or alternatively, the data from the integrated environmental sensors may be provided to external systems for any variety of purposes.

In some embodiments, aspects of the present disclosure may further include a back-end access control determination server that implements one or more rules to determine whether to unlock/open a door based on an unlock signal transmitted by the electronic key device. For example, the access control determination server may implement a set of rules that permit or deny access not only based on a device or user ID, but also based on a variety of additional dynamic factors (e.g., time of day, environmental data, facility security levels, event data, signal strength data of the unlock signal, proximity detection data, etc.). In this way, the access of an area may be dynamically updated based on a rich set of data and rules. Further, managing the access of an area may be simplified and manual updating of access lists may be reduced or eliminated. As one illustrative example, access may be granted for a particular user (e.g., by sending an unlock instruction to a door lock controller) under one set of conditions (e.g., environmental conditions indicating an emergency situation), but may not be granted under a different set of conditions (e.g., environmental conditions indicating a non-emergency situation).

In some embodiments, the functions of the access control determination server may be integrated within the access device reader. That is, the access device reader may independently make a determination as to whether to effectuate an unlock of a door based on a set of rules, without involving a back-end server.

Embodiments of the disclosure may include a system, a method, and/or a computer program product at any possible technical detail level of integration. The computer program product may include a computer readable storage medium (or media) having computer readable program instructions thereon for causing a processor to carry out aspects of the present disclosure.

FIG. 1A illustrates an overview of an example implementation in accordance with aspects of the present disclosure. In general, the electronic key device 110 provides an unlock signal having a device ID (at step 1.1), to an access reader device 120 implemented at a door. The access reader device 120 may provide the unlock signal to a door access controller 130 (at step 1.3), which provides the unlock signal to an access control determination server 140 (at step 1.4). The access control determination server 140 determines (at step 1.5) whether to effectuate unlocking of the door based on one or more of the device ID from the unlock signal and additional dynamic factors (e.g., time of day, environmental data, facility security levels, event data, signal strength data of the unlock signal, proximity detection data, etc.). The access control determination server 140 provides an access result check (at step 1.6) that indicates whether or not to unlock the door. If the door is to be unlocked, the door access controller 130 provides a control signal to lock/opening hardware 150 to unlock/open the door (at step 1.8) and the door access controller 130 provides a signal to the access reader device 120 to illuminate a light (e.g., an LED) based on whether the door is to be unlocked or remain locked.

In more specific detail, and as further shown in FIG. 1A, an electronic key device 110 (e.g., a keycard, a fob, mobile device, etc.) may output an unlock signal (e.g., at step 1.1). For example, the electronic key device 110 may continuously broadcast the unlock signal (e.g., in the form of a BLE signal, an NFC signal, etc.). Additionally, or alternatively, the electronic key device 110 may output the unlock signal based on user input (e.g., a physical or virtual button press, a user instruction provided through a graphical user interface, etc.). In some embodiments, the electronic key device 110 may only output the unlock signal based on performing an authentication check of the user (e.g., authentication based on biometrics data, facial recognition, voice recognition, username/password information, etc.) In some embodiments, the unlock signal may include information, such as device ID of the electronic key device 110.

At step 1.2, the access reader device 120 may receive the unlock signal, and disposition the unlock signal. For example, the access reader device 120 may disposition the unlock signal by either ignoring or disregarding the signal, or providing the signal (or information carried by the signal) to a door access controller 130. In some embodiments, the access reader device 120 may implement any variety of rules to determine the signal disposition. For example, the access reader device 120 may ignore signals having a signal strength lower than a particular threshold (e.g., indicating that the electronic key device 110 is greater than a threshold distanced from the access reader device 120). In this way, the threshold distance of an electronic key device 110 to the access reader device 120 for unlocking a door may be modified and configurable. As another example, the access reader device 120 may ignore signals that have been received for less than a threshold period of time, or to act on signals only after the electronic key device 110 has been in proximity of the access reader device 120 for a threshold period of time (e.g., 3 seconds). This type of rule may prevent the access reader device 120 from sending the unlock signal towards the access control determination server 140 in order to prevent accidental unlocking of the door.

Assuming that the access reader device 120 determines that the unlock signal should not be ignored, at step 1.3, the access reader device 120 may provide unlock signal with the device ID to the door access controller 130. In some embodiments, the access reader device 120 may communicate with the door access controller 130 via a wired and/or wireless connection. As one example, the access reader device 120 and the door access controller 130 may conform with via Wiegand 26-bit for communications for compatibility with electrified strike lock systems, and input for magnetic door sensors.

At step 1.4, the door access controller 130 may provide the device ID and a door ID to the access control determination server 140. At step 1.5, the access control determination server 140 may perform an access check to determine whether or not to permit or deny entry (e.g., effectuate unlocking of the door) based on a variety of configurable and customizable rules, variables, and parameters. In general, the access control determination server 140 may determine whether or not a user associated with the device ID is permitted to access an area associated with the door ID (e.g., based on manually and/or automatically configurable and dynamic access control information stored by the access control determination server 140). Further, the access control determination server 140 may determine whether or not a user associated with the device ID is permitted to access an area associated with the door ID based on a set of dynamic conditions, as described herein. In some embodiments, the access control determination server 140 may receive environmental conditions from the integrated environmental sensors of the access reader device 120 (and/or from other sources) as part of performing the access check. In some embodiments, the access control determination server 140 may receive any variety of auxiliary information or instructions from an external source (e.g., external server or system) in which the auxiliary information/instructions may be used as part of the decision of whether or not to permit or deny entry.

At step 1.6, the access control determination server 140 may provide results of the access check (e.g., an indication of whether to permit or deny access). If access is to be permitted, the door access controller 130 (at step 1.7) may provide a control signal to the lock/opening hardware 150 to unlock/open the door (and subsequently close/lock the door after a period of time). Further, the door access controller 130 may provide a light signal (e.g., at step 1.8) to direct the access reader device 120 to illuminate a light integrated within the access reader device 120 in a certain manner (e.g., with a certain color, such as green) and with a certain blink pattern/duration. If access is not permitted, the door access controller 130 may not provide a control signal to the lock/opening hardware 150, thereby keeping the door locked/closed. The door access controller 130 may provide a different light signal to direct the access reader device 120 to illuminate a light integrated within the access reader device 120 in a certain manner (e.g., with a different color, such as red and with a different blink pattern/duration). In some embodiments, the door access controller 130 may be compatible with any variety of lock/opening hardware 150 using the Wiegand protocol and/or any other type of communication protocol.

In some embodiments, the light(s) integrated within the access reader device 120 may illuminate in different manners based on different instructions/signals received from the electronic key device 110. For example, the light(s) integrated within the access reader device 120 may illuminate in particular manner based on a distress signal provided by the electronic key device 110 in which a certain user inputs are used to provide the distress signal (e.g., greater than a threshold number of button presses in a short amount of time, user input of a distress signal through a graphical user interface, etc.). In some embodiments, the distress signal may be used to override access controls and allow access to an area in an emergency situation.

Figure 1B:
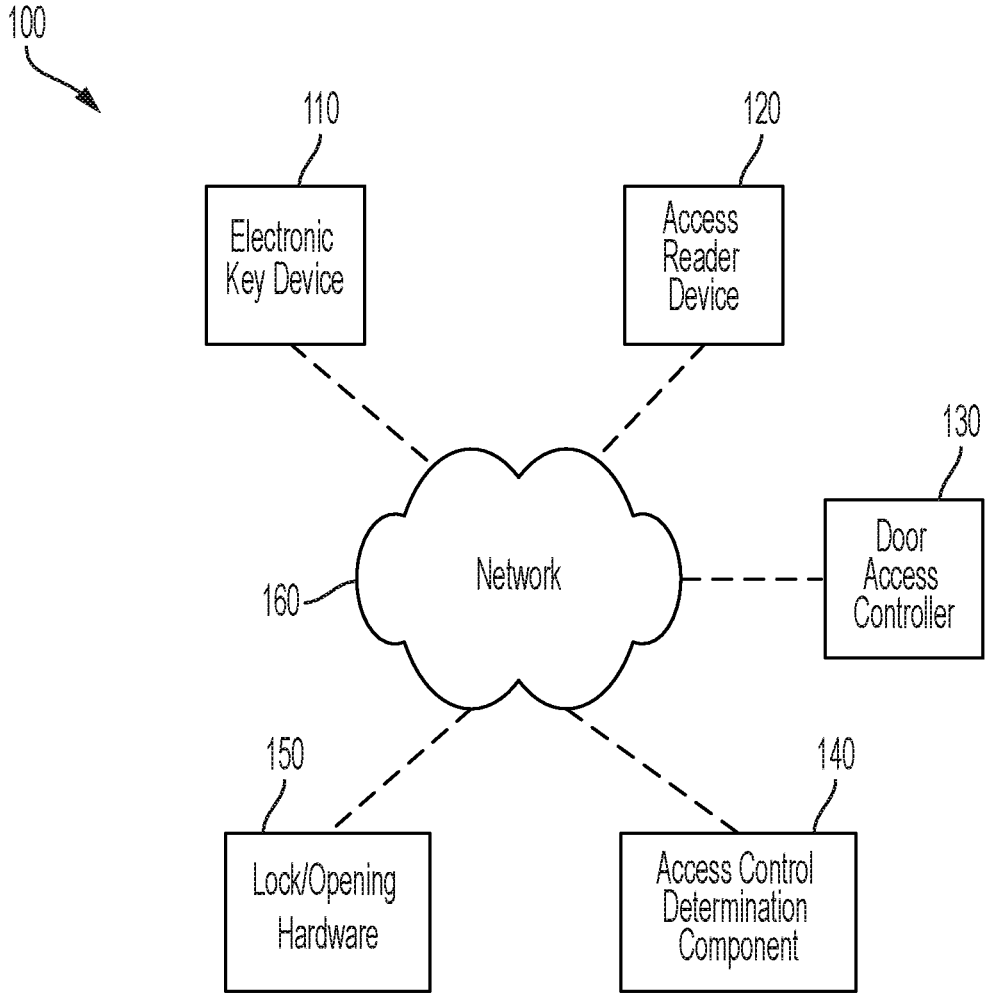
FIG. 1B illustrates an example environment in accordance with aspects of the present disclosure.

FIG. 1B illustrates an example environment in accordance with aspects of the present disclosure. As shown in FIG. 1B, environment 100 includes the electronic key device 110, the access reader device 120, the door access controller 130, the access control determination server 140, the lock/opening hardware 150, and a network 160. As further shown in FIG. 1B, each of the electronic key device 110, the access reader device 120, the door access controller 130, the access control determination server 140, and the lock/opening hardware 150 may communicate with each other via a network 160.

The network 160 may include network nodes and one or more wired and/or wireless networks. For example, the network 160 may include a personal area network (PAN) such as a Bluetooth network, BLE network, NFC network, cellular network (e.g., a second generation (2G) network, a third generation (3G) network, a fourth generation (4G) network, a fifth generation (2G) network, a long-term evolution (LTE) network, a global system for mobile (GSM) network, a code division multiple access (CDMA) network, an evolution-data optimized (EVDO) network, or the like), a public land mobile network (PLMN), and/or another network. Additionally, or alternatively, the network 160 may include a local area network (LAN), a wide area network (WAN), a metropolitan network (MAN), the Public Switched Telephone Network (PSTN), an ad hoc network, a managed Internet Protocol (IP) network, a virtual private network (VPN), an intranet, the Internet, a fiber optic-based network, a Wiegand network, and/or a combination of these or other types of networks. In embodiments, the network 160 may include copper transmission cables, optical transmission fibers, wireless transmission, routers, firewalls, switches, gateway computers and/or edge servers.

The quantity of devices and/or networks in the environment 100 is not limited to what is shown in FIG. 1B. In practice, the environment 100 may include additional devices and/or networks; fewer devices and/or networks; different devices and/or networks; or differently arranged devices and/or networks than illustrated in FIG. 1B. Also, in some implementations, one or more of the devices of the environment 100 may perform one or more functions described as being performed by another one or more of the devices of the environment 100. Devices of the environment 100 may interconnect via wired connections, wireless connections, or a combination of wired and wireless connections.

Figure 2:
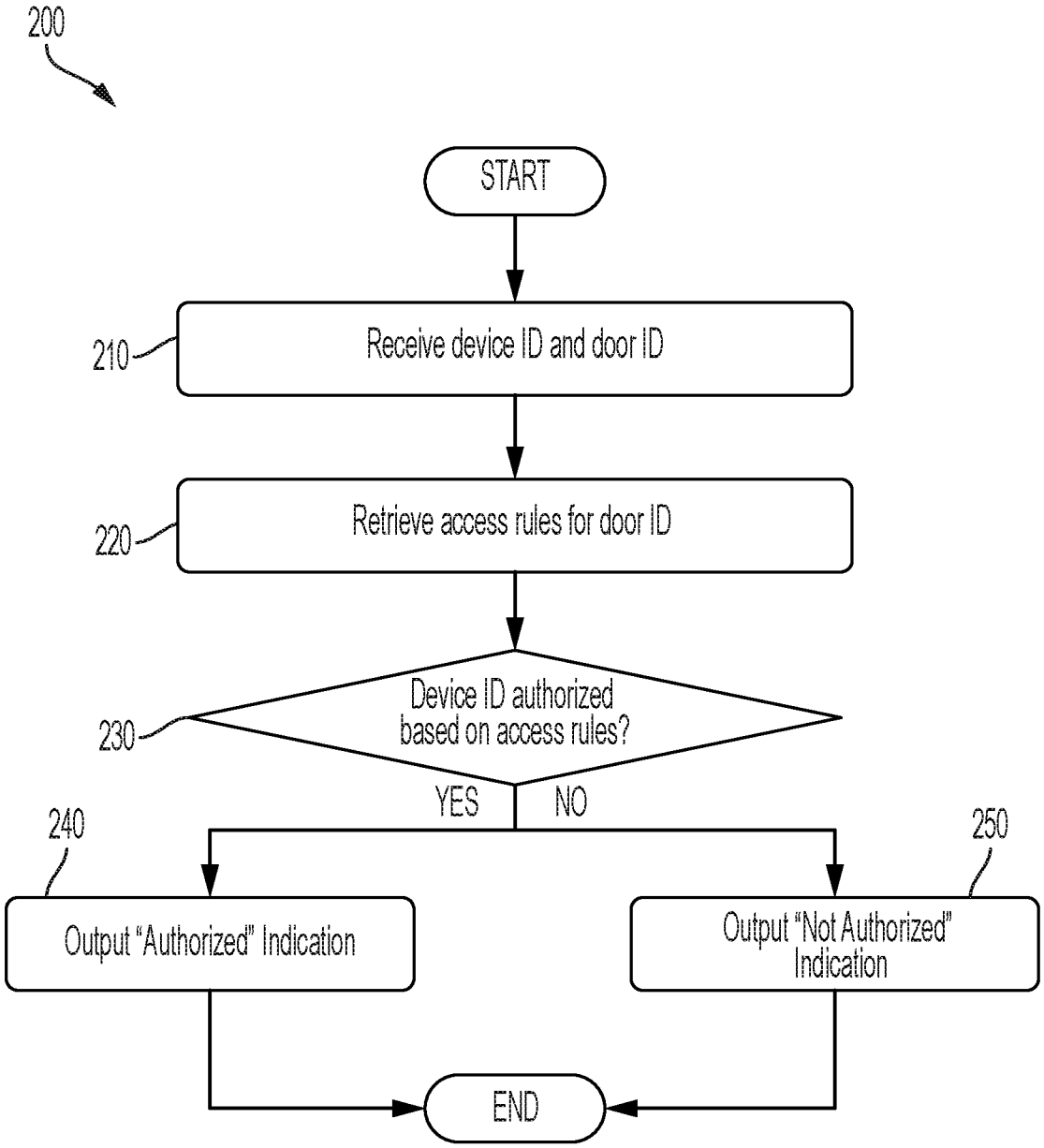
FIG. 2 illustrates an example flowchart of a process for determining whether to permit or deny access based on receiving an unlock signal.

FIG. 2 illustrates an example flowchart of a process for determining whether to permit or deny access based on receiving an unlock signal. The blocks of FIG. 2 may be implemented in the environment of FIG. 2, for example, and are described using reference numbers of elements depicted in FIG. 2. The flowchart illustrates the architecture, functionality, and operation of possible implementations of systems, methods, and computer program products according to various embodiments of the present disclosure.

As shown in FIG. 2, process 200 may include receiving a device ID and a door ID (block 210). For example, the access control determination server 140 may receive the device ID and the door ID from the door access controller 130 (e.g., when the access reader device 120 receives an unlock signal from the electronic key device 110).

Process 200 also may include retrieving access rules for the door ID (block 220). For example, the access control determination server 140 may retrieve access rules for the door ID from a data structure stored by the access control determination server 140. In some embodiments, the access rules for the door ID indicates device IDs that are authorized to access the area associated with the door ID. Additionally, or alternatively, the access rules indicate other conditions under which the device IDs are authorized to access the area associated with the door ID (e.g., dynamic conditions, such as time of day, environmental data, facility security levels, event data, signal strength data of the unlock signal, proximity detection data, distress signal presence, emergency event data, environmental conditions indicating an emergency situation, etc.).

Process 200 further may include determining whether the device ID is authorized based on the access rules (block 230). For example, the access control determination server 140 may determine whether the device ID is authorized based on the access rules, and more specifically, based on the dynamic conditions under which the device ID is authorized.

If, for example, the device ID is authorized (block 230-YES), process 200 also may include outputting an "authorized" indication (block 240). For example, the access control determination server 140 may output an authorized indication (e.g., an access check result including the "authorized" indication) to the door access controller 130. The door access controller 130 may then proceed to effectuate unlocking of the door via the lock/opening hardware 150.

If, on the other hand, the device ID is not authorized (block 230-NO) process 200 further may include outputting an "authorized" indication (block 260). For example, the access control determination server 140 may output an unauthorized indication (e.g., an access check result including the "unauthorized" indication) to the door access controller 130. The door access controller 130 may then take no action in terms of unlocking the door, and thus, may keep the door locked/closed.

Figure 3:
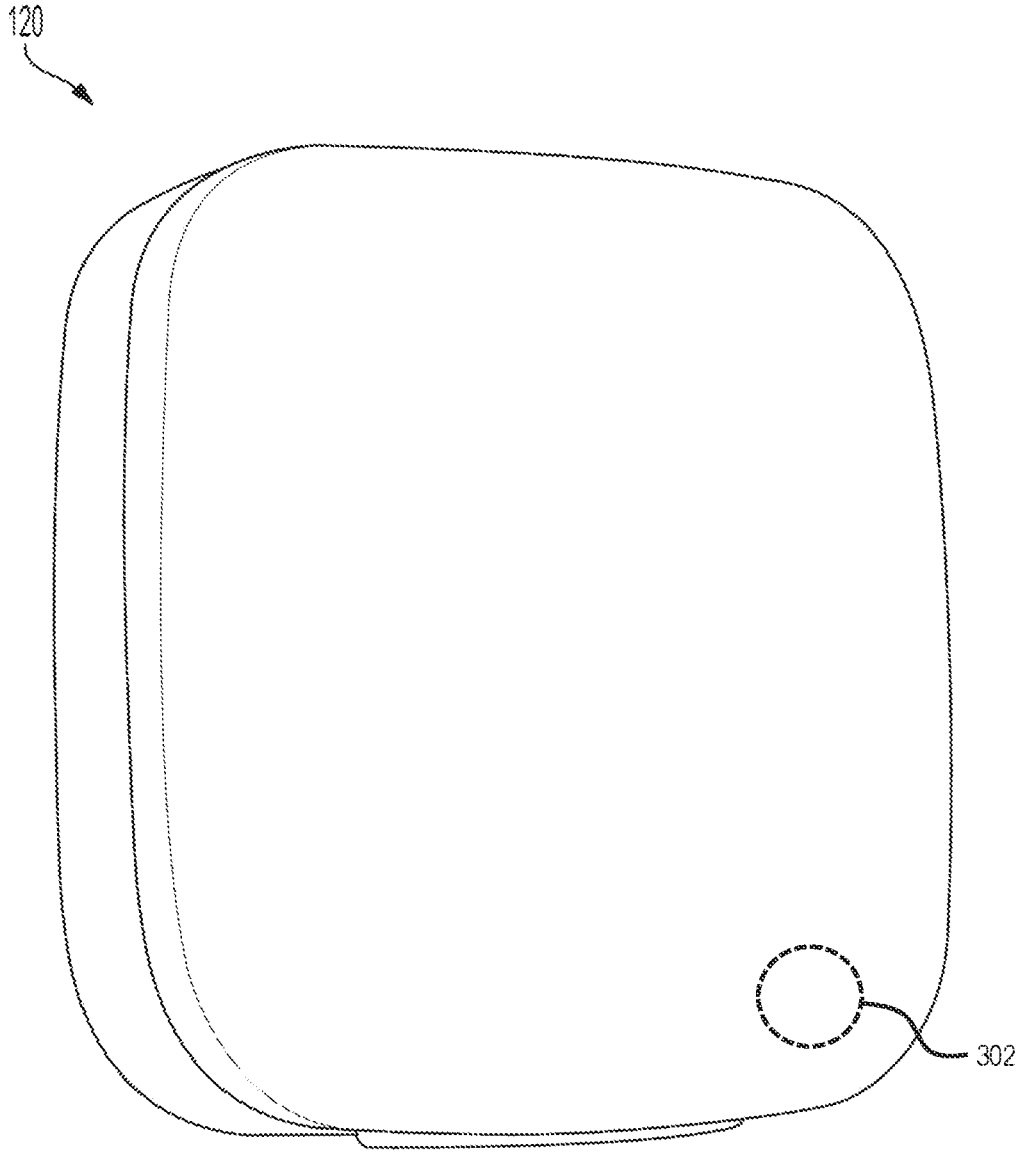
FIG. 3 illustrates an example of the access reader device in accordance with aspects of the present disclosure.

FIG. 3 illustrates an example of the access reader device 120 in accordance with aspects of the present disclosure. In some embodiments, the access reader device 120 may be approximately 4.5"×4.5"×1.2." The access reader device 120 includes an environmental sensor 302.

Figure 4:
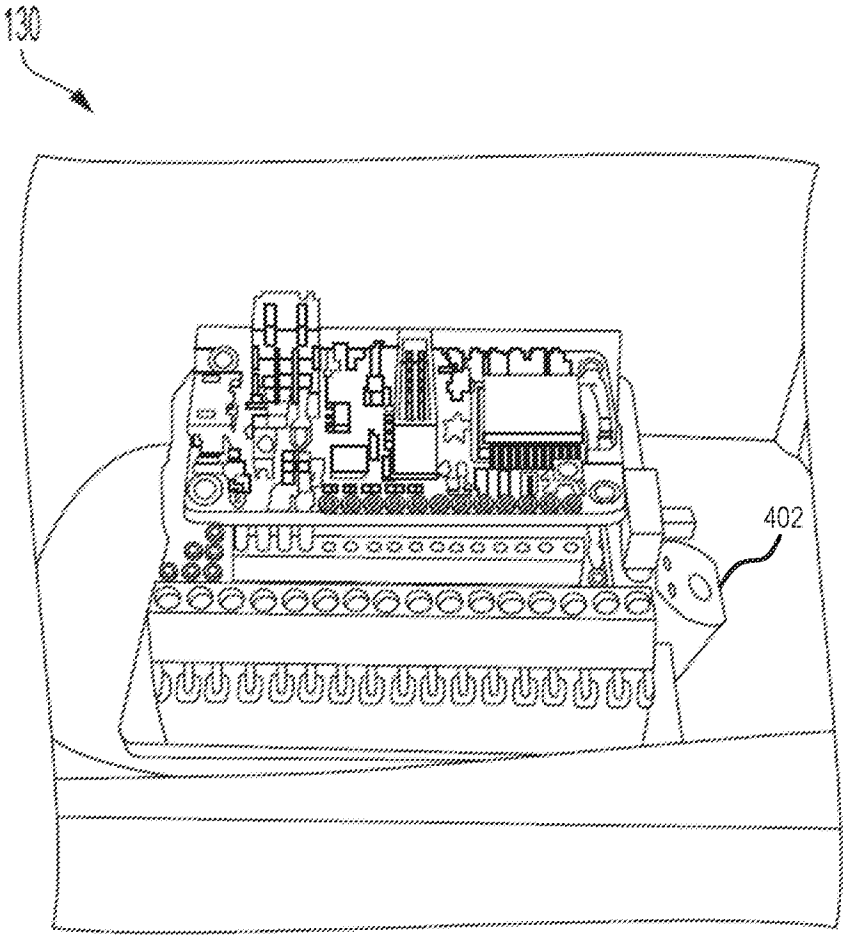
FIG. 4 illustrates an example of the door access controller in accordance with aspects of the present disclosure.

FIG. 4 illustrates an example of the door access controller 130 in accordance with aspects of the present disclosure. The access controller 130 includes an environmental sensor 402. As shown in FIG. 4, the door access controller 130 may include a printed circuit board (PCB) with terminal blocks. A diagram of the signals associated with the terminal blocks is also shown.

Figure 5:
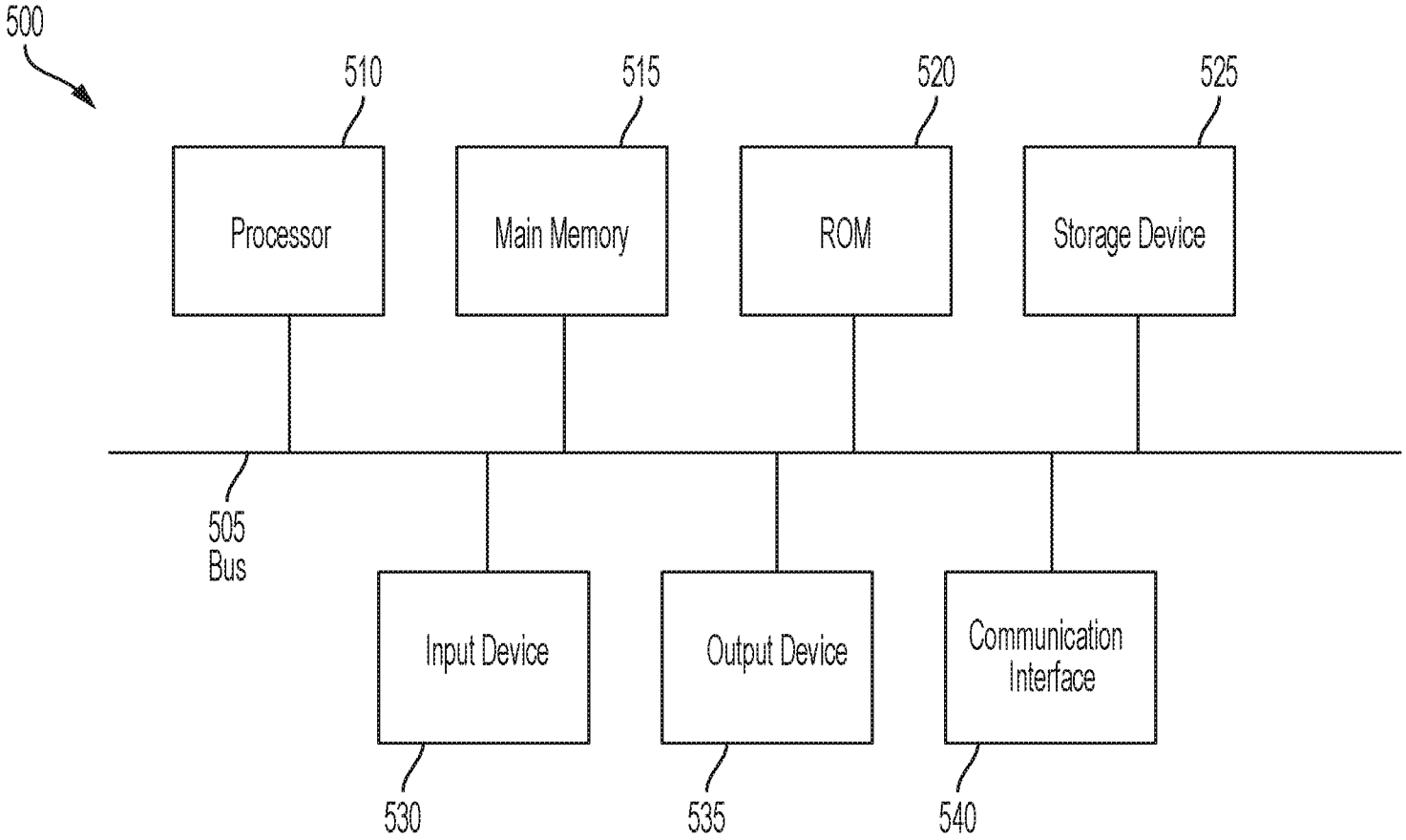
FIG. 5 illustrates example components of a device that may be used within environment of FIG. 1B.

FIG. 5 illustrates example components of a device 500 that may be used within environment 100 of FIG. 1B. Device 500 may correspond to the electronic key device 110, the access reader device 120, the lock/opening hardware 150, the access control determination server 140, and the lock/opening hardware 150. Each of the electronic key device 110, the access reader device 120, the lock/opening hardware 150, the access control determination server 140, and the lock/opening hardware 150 may include one or more devices 500 and/or one or more components of device 500.

As shown in FIG. 5, device 500 may include a bus 505, a processor 510, a main memory 515, a read only memory (ROM) 520, a storage device 525, an input device 550, an output device 555, and a communication interface 540.

Bus 505 may include a path that permits communication among the components of device 500. Processor 510 may include a processor, a microprocessor, an application specific integrated circuit (ASIC), a field programmable gate array (FPGA), or another type of processor that interprets and executes instructions. Main memory 515 may include a random access memory (RAM) or another type of dynamic storage device that stores information or instructions for execution by processor 510. ROM 520 may include a ROM device or another type of static storage device that stores static information or instructions for use by processor 510. Storage device 525 may include a magnetic storage medium, such as a hard disk drive, or a removable memory, such as a flash memory.

Input device 550 may include a component that permits an operator to input information to device 500, such as a control button, a keyboard, a keypad, or another type of input device. Output device 555 may include a component that outputs information to the operator, such as a light emitting diode (LED), a display, or another type of output device. Communication interface 540 may include any transceiver-like component that enables device 500 to communicate with other devices or networks. In some implementations, communication interface 540 may include a wireless interface, a wired interface, or a combination of a wireless interface and a wired interface. In embodiments, communication interface 540 may receiver computer readable program instructions from a network and may forward the computer readable program instructions for storage in a computer readable storage medium (e.g., storage device 525).

Device 500 may perform certain operations, as described in detail below. Device 500 may perform these operations in response to processor 510 executing software instructions contained in a computer-readable medium, such as main memory 515. A computer-readable medium may be defined as a non-transitory memory device and is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire. A memory device may include memory space within a single physical storage device or memory space spread across multiple physical storage devices.

The software instructions may be read into main memory 515 from another computer-readable medium, such as storage device 525, or from another device via communication interface 540. The software instructions contained in main memory 515 may direct processor 510 to perform processes that will be described in greater detail herein. Alternatively, hardwired circuitry may be used in place of or in combination with software instructions to implement processes described herein. Thus, implementations described herein are not limited to any specific combination of hardware circuitry and software.

In some implementations, device 500 may include additional components, fewer components, different components, or differently arranged components than are shown in FIG. 5.

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The flowchart and block diagrams in the Figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Embodiments of the disclosure may include a system, a method, and/or a computer program product at any possible technical detail level of integration. The computer program product may include a computer readable storage medium (or media) having computer readable program instructions thereon for causing a processor to carry out or execute aspects and/or processes of the present disclosure.

In embodiments, the computer readable program instructions may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on a user's computer, partly on the user's computer, as a stand-alone software package, partly on the user's computer and partly on a remote computer or entirely on the remote computer or server.

In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

In embodiments, a service provider could offer to perform the processes described herein. In this case, the service provider can create, maintain, deploy, support, etc., the computer infrastructure that performs the process steps of the disclosure for one or more customers. These customers may be, for example, any business that uses technology. In return, the service provider can receive payment from the customer(s) under a subscription and/or fee agreement and/or the service provider can receive payment from the sale of advertising content to one or more third parties.

The foregoing description provides illustration and description, but is not intended to be exhaustive or to limit the possible implementations to the precise form disclosed. Modifications and variations are possible in light of the above disclosure or may be acquired from practice of the implementations.

It will be apparent that different examples of the description provided above may be implemented in many different forms of software, firmware, and hardware in the implementations illustrated in the figures. The actual software code or specialized control hardware used to implement these examples is not limiting of the implementations. Thus, the operation and behavior of these examples were described without reference to the specific software code—it being understood that software and control hardware can be designed to implement these examples based on the description herein.

Even though particular combinations of features are recited in the claims and/or disclosed in the specification, these combinations are not intended to limit the disclosure of the possible implementations. In fact, many of these features may be combined in ways not specifically recited in the claims and/or disclosed in the specification. Although each dependent claim listed below may directly depend on only one other claim, the disclosure of the possible implementations includes each dependent claim in combination with every other claim in the claim set.

While the present disclosure has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the disclosure.

No element, act, or instruction used in the present application should be construed as critical or essential unless explicitly described as such. Also, as used herein, the article "a" is intended to include one or more items and may be used interchangeably with "one or more." Where only one item is intended, the term "one" or similar language is used. Further, the phrase "based on" is intended to mean "based, at least in part, on" unless explicitly stated otherwise.

What is claimed is:

1. A computer-implemented method comprising:

receiving a device ID and a door ID;

retrieving a dynamic set of access rules for the door ID;

determining whether the device ID is authorized based on the dynamic set of access rules;

outputting an indication indicating that the device ID is authorized to effectuate unlocking or opening of a door associated with the door ID; and outputting an indication indicating that the device ID is not authorized to prevent unlocking or opening of the door.

2. The computer-implemented method of claim 1, wherein the device ID is provided via an unlock signal provided by an electronic key device.

3. The computer-implemented method of claim 2, wherein the electronic key device includes at least one of:

a keycard;

a fob; and a mobile user device.

4. The computer-implemented method of claim 2, wherein the electronic key device provides the unlock signal through user input, wherein the user input comprises at least one of:

a press of a physical button implemented on the electronic key device; and user input received via a graphical user interface implemented by the electronic key device.

5. The computer-implemented method of claim 1, wherein the device ID is received from an electronic key device via an access reader device.

6. The computer-implemented method of claim 5, wherein the access reader device comprises one or more environmental sensors for collecting environmental data.

7. The computer-implemented method of claim 6, wherein the environmental data obtained from the access reader device is included in the dynamic set of access rules.

8. A system comprising:

an electronic key device configured to provide an unlock signal comprising a device ID;

an access reader configured to receive the unlock signal and transmit the unlock signal;

a door access controller configured to receive the unlock signal and provide the device ID from the unlock signal and provide a door ID of a door controlled by the door access controller;

an access control determination server comprising a computer readable storage medium having program instructions embodied therewith, the program instructions executable by a computing device to cause the computing device to perform operations comprising:

receiving the device ID and the door ID from the door access controller;

retrieving a dynamic set of access rules for the door ID;

determining whether the device ID is authorized based on the dynamic set of access rules;

outputting, to the door access controller, an indication indicating that the device ID is authorized to effectuate unlocking or opening of a door associated with the door ID via the door access controller; and outputting an indication indicating that the device ID is not authorized to prevent unlocking or opening of the door.

9. The system of claim 8, wherein the electronic key device is further configured to provide the unlock signal based on authenticating a user of the electronic key.

10. The system of claim 8, wherein the electronic key device is further configured to continuously provide the unlock signal.

11. The system of claim 8, wherein the electronic key is further configured to provide the unlock signal via a personal area network (PAN).

12. The system of claim 8, wherein the access controller is configured to transmit the unlock signal based on a signal strength of the unlock signal received from the electronic key device, wherein the signal strength is indicative of a distance between the electronic key device and the access controller.

13. The system of claim 8, wherein the access controller includes at least one integrated environmental sensor and is configured to provide data from the environmental sensor to the access control determination server.

14. A computer program product comprising a computer readable storage medium having program instructions embodied therewith, the program instructions executable by a computing device to cause the computing device to perform operations comprising:

receiving a device ID and a door ID;

retrieving a dynamic set of access rules for the door ID;

determining whether the device ID is authorized based on the dynamic set of access rules;

outputting an indication indicating that the device ID is authorized to effectuate unlocking or opening of a door associated with the door ID; and outputting an indication indicating that the device ID is not authorized to prevent unlocking or opening of the door.

15. The computer program product of claim 14, wherein the device ID is provided via an unlock signal provided by an electronic key device.

16. The computer program product of claim 15, wherein the electronic key device includes at least one of:

a keycard;

a fob; and a mobile user device.

17. The computer program product of claim 15, wherein the electronic key device provides the unlock signal through user input, wherein the user input comprises at least one of:

a press of a physical button implemented on the electronic key device; and user input received via a graphical user interface implemented by the electronic key device.

18. The computer program product of claim 14, wherein the device ID is received from an electronic key device via an access reader device.

19. The computer program product of claim 18, wherein the access reader device comprises one or more environmental sensors for collecting environmental data.

20. The computer program product of claim 19, wherein the environmental data obtained from the access reader device is included in the dynamic set of access rules.

* * * * *